US005611587A

United States Patent [19]

Brown

[11] Patent Number: 5,611,587

[45] Date of Patent: Mar. 18, 1997

[54] PORTABLE CLAW DEVICE

[76] Inventor: Tom Brown, 708 S. Helena St., Anaheim, Calif. 92805

[21] Appl. No.: 559,918

[22] Filed: Nov. 17, 1995

[51] Int. Cl.[6] ..... B66C 1/28

[52] U.S. Cl. ..... 294/106; 294/111; 294/116

[58] Field of Search ..... 294/66.1, 66.2, 294/86.26, 86.28, 86.29, 86.3, 100, 106, 111, 112, 113, 116

[56] References Cited

U.S. PATENT DOCUMENTS

| | | | |
|---|---|---|---|
| 557,113 | 3/1896 | Davison | 294/112 |
| 967,130 | 8/1910 | Jones | 294/66.1 |
| 980,920 | 1/1911 | Burnes | 294/86.3 |
| 1,580,416 | 4/1926 | Cromwell et al. | 294/111 |
| 1,876,339 | 9/1932 | Oberle | 294/86.29 |
| 1,927,528 | 9/1933 | Nilsson | 294/116 |
| 3,833,252 | 9/1974 | Redding | 294/100 |
| 4,368,913 | 1/1983 | Brockmann et al. | 294/106 |

*Primary Examiner*—Dean Kramer

[57] ABSTRACT

A portable claw device includes a cylindrical housing having a pair of diametrically opposed vertical slots formed therein. A pair of gripping claws are coupled together by a cross bar with the cross bar slidably received within the pair of diametrically opposed vertical slots of the cylindrical housing. The cross bar has a vertical support bar extending upwardly from a central portion thereof.

5 Claims, 3 Drawing Sheets

FIG 3
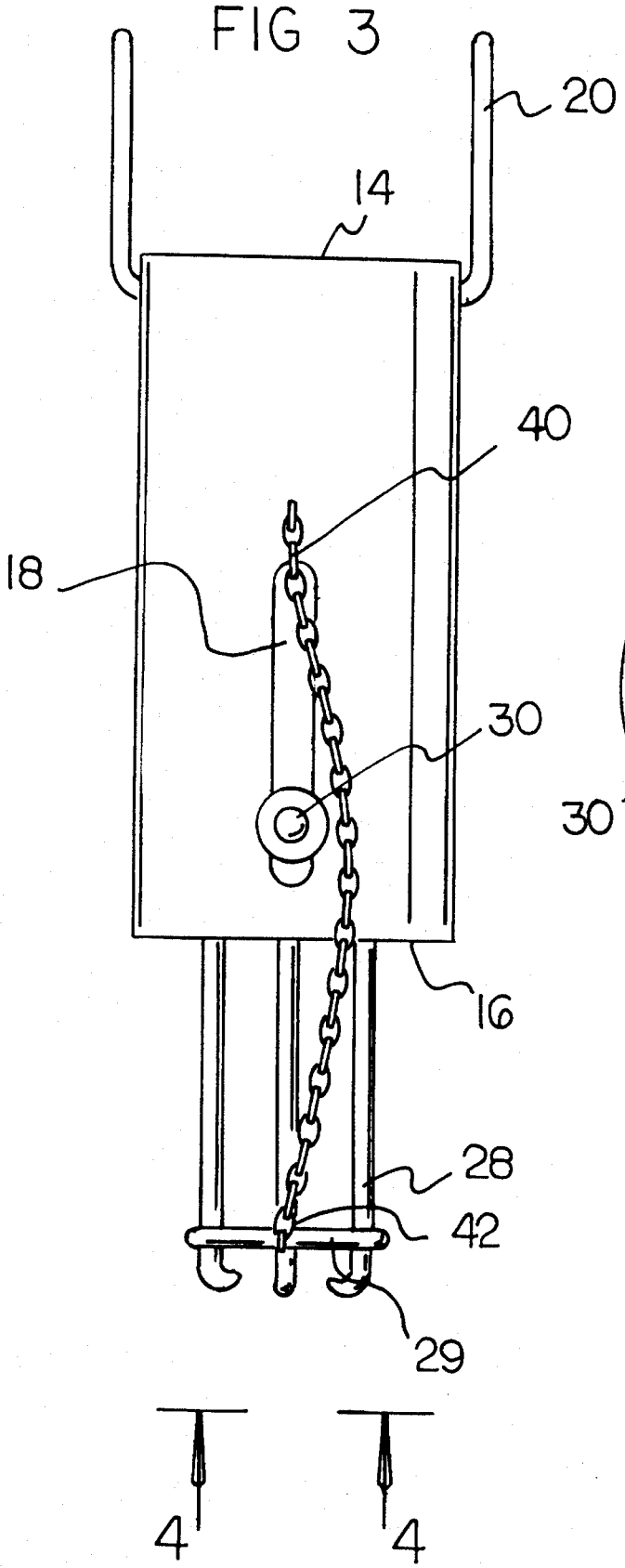
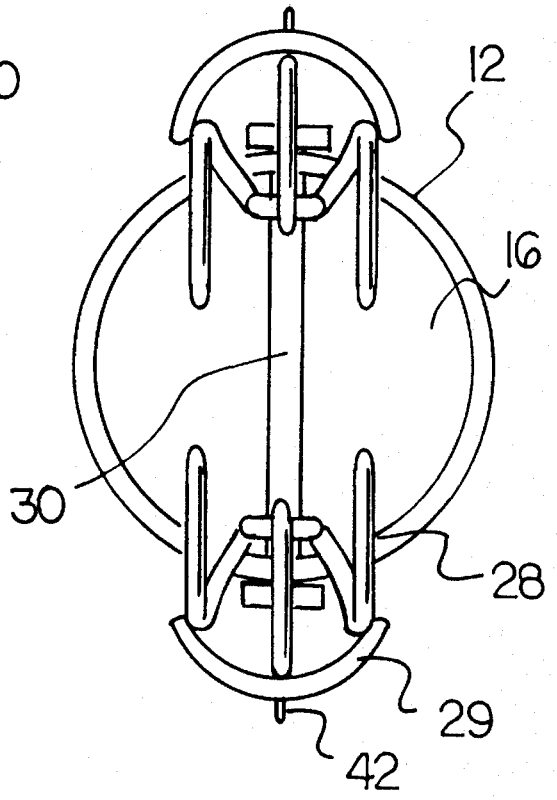
FIG 4

FIG 5
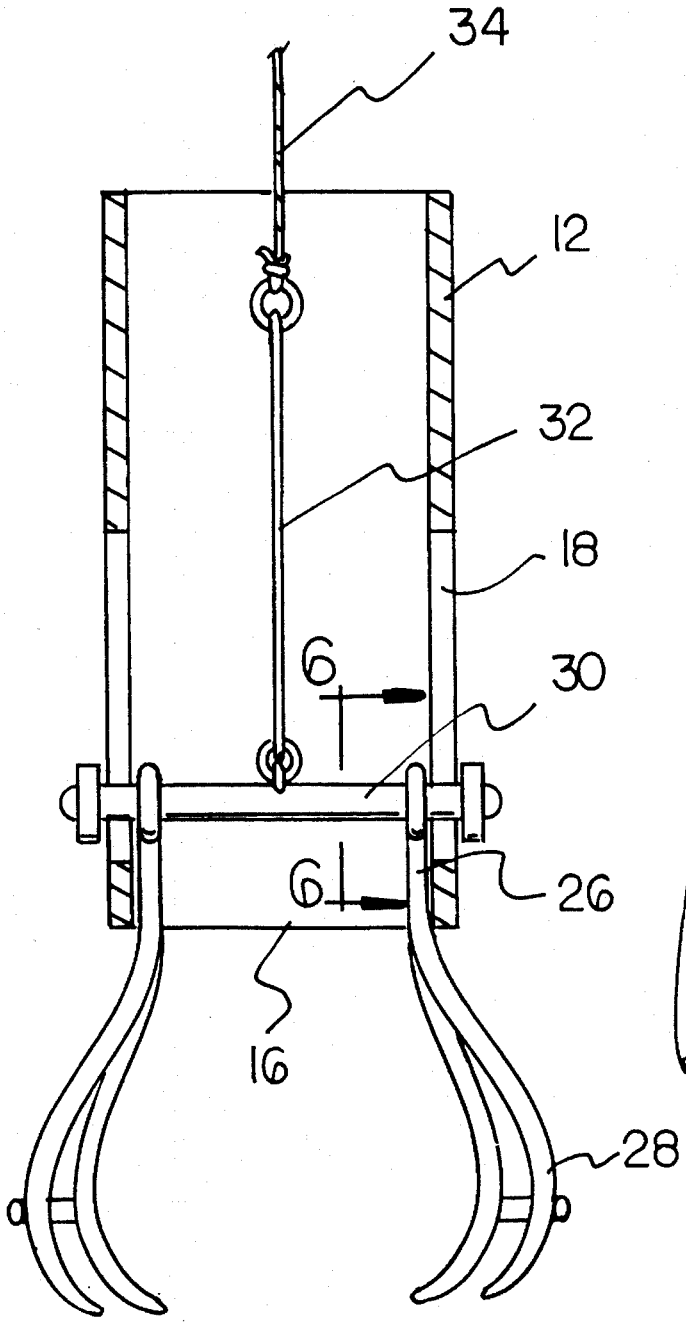
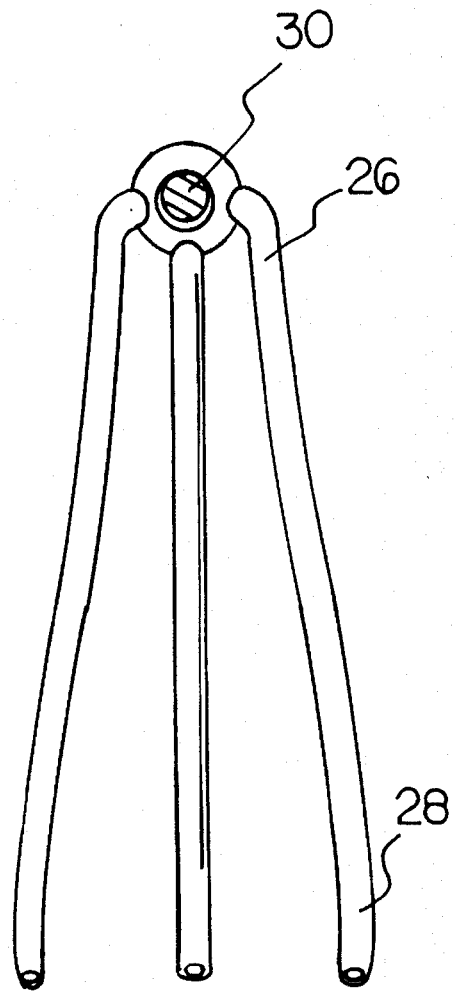
FIG 6

PORTABLE CLAW DEVICE

BACKGROUND OF THE INVENTION

1. Field of the Invention

The present invention relates to a portable claw device and more particularly pertains to engaging materials to be uplifted with a portable claw device.

2. Description of the Prior Art

The use of lifting device is known in the prior art. More specifically, lifting device heretofore devised and utilized for the purpose of lifting materials are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,469,879 to Tezuka discloses a tong device for metal scrap blocks.

U.S. Pat. No. 3,971,478 to Matasa discloses an overhead crane with lifting beam provided with C-shaped claws.

U.S. Pat. No. Des. 340,792 to Lacey discloses the ornamental design for a spring-loaded grabbing and hoisting tongs.

U.S. Pat. No. 4,749,328 to Lanigan, Jr. et al. discloses an auxiliary hoist grapple.

U.S. Pat. No. 5,143,179 to Hornstein discloses a lifting hoist for motor vehicles.

U.S. Pat. No. 4,717,189 to Gabriel discloses a tong-like, cable-scooping, hoist-cable coupling device for suspended loads.

While these devices fulfill their respective, particular objective and requirements, the aforementioned patents do not describe a portable claw device for engaging materials to be uplifted.

In this respect, the portable claw device according to the present invention substantially departs from the conventional concepts and designs of the prior art, and in doing so provides an apparatus primarily developed for the purpose of engaging materials to be uplifted.

Therefore, it can be appreciated that there exists a continuing need for new and improved portable claw device which can be used for engaging materials to be uplifted. In this regard, the present invention substantially fulfills this need.

SUMMARY OF THE INVENTION

In the view of the foregoing disadvantages inherent in the known types of lifting device now present in the prior art, the present invention provides an improved portable claw device. As such, the general purpose of the present invention, which will be described subsequently in greater detail, is to provide a new and improved portable claw device and method which has all the advantages of the prior art and none of the disadvantages.

To attain this, the present invention essentially comprises a cylindrical housing having an open upper end and an open lower end. The cylindrical housing has a pair of diametrically opposed vertical slots formed therein intermediate the upper end and lower end thereof. The open upper end has a pair of inverted U-shaped handles secured thereto. The device includes a pair of gripping claws. Each of the gripping claws has a central upper end portion and a plurality of arcuate lower portions. Each upper end portion is coupled together by a cross bar. The cross bar is slidably received within the pair of diametrically opposed vertical slots of the cylindrical housing. The cross bar has a vertical support bar extending upwardly from a central portion thereof. The vertical support bar has a lift line secured to an upper end thereof. The device includes a pair of lifting chains. Each of the lifting chains has a first end and a second end. The first ends are secured to the cylindrical housing upwardly of the pair of diametrically opposed vertical slots. The second ends are secured to the arcuate lower portion of the pair of gripping claws.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable claw device which has all the advantages of the prior art lifting device and none of the disadvantages.

It is another object of the present invention to provide a new and improved portable claw device which may be easily and efficiently manufactured and marketed.

It is a further object of the present invention to provide a new and improved portable claw device which is of durable and reliable construction.

An even further object of the present invention is to provide a new and improved portable claw device which is susceptible of a low cost of manufacture with regard to both materials and labor, and which accordingly is then susceptible of low prices of sale to the consuming public, thereby making such a portable claw device economically available to the buying public.

Still yet another object of the present invention is to provide a new and improved portable claw device which provides in the apparatuses and methods of the prior art some of the advantages thereof, while simultaneously overcoming some of the disadvantages normally associated therewith.

Even still another object of the present invention is to provide a new and improved portable claw device for engaging materials to be uplifted.

Lastly, it is an object of the present invention to provide a new and improved portable claw device includes a cylindrical housing having a pair of diametrically opposed vertical slots formed therein. A pair of gripping claws are coupled together by a cross bar with the cross bar slidably received within the pair of diametrically opposed vertical slots of the cylindrical housing. The cross bar has a vertical support bar extending upwardly from a central portion thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevation view of the present invention.

FIG. 4 is a bottom view of the present invention as taken along line 4—4 of FIG. 3.

FIG. 5 is a cross-sectional view of the present invention.

FIG. 6 is a cross-sectional view as taken along line 6—6 of FIG. 5.

The same reference numerals refer to the same parts through the various Figures.

DESCRIPTION OF THE PREFERRED EMBODIMENT

Figure 1:
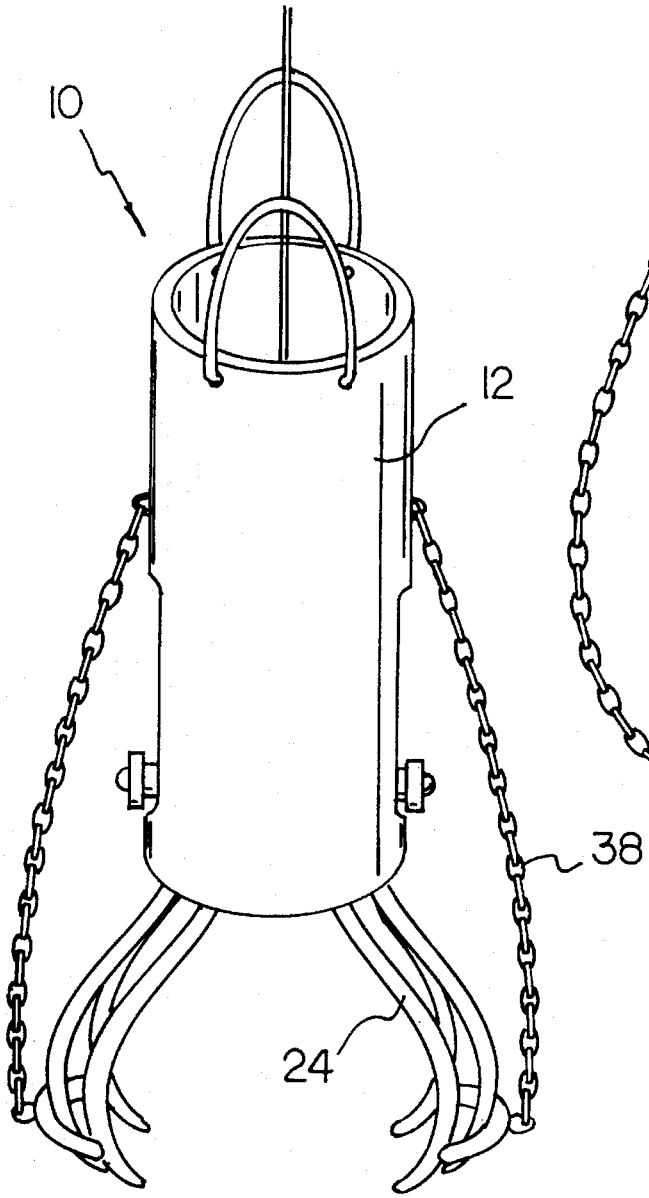
FIG. 1 is a front view of the preferred embodiment of the portable claw device constructed in accordance with the principles of the present invention.
Figure 2:
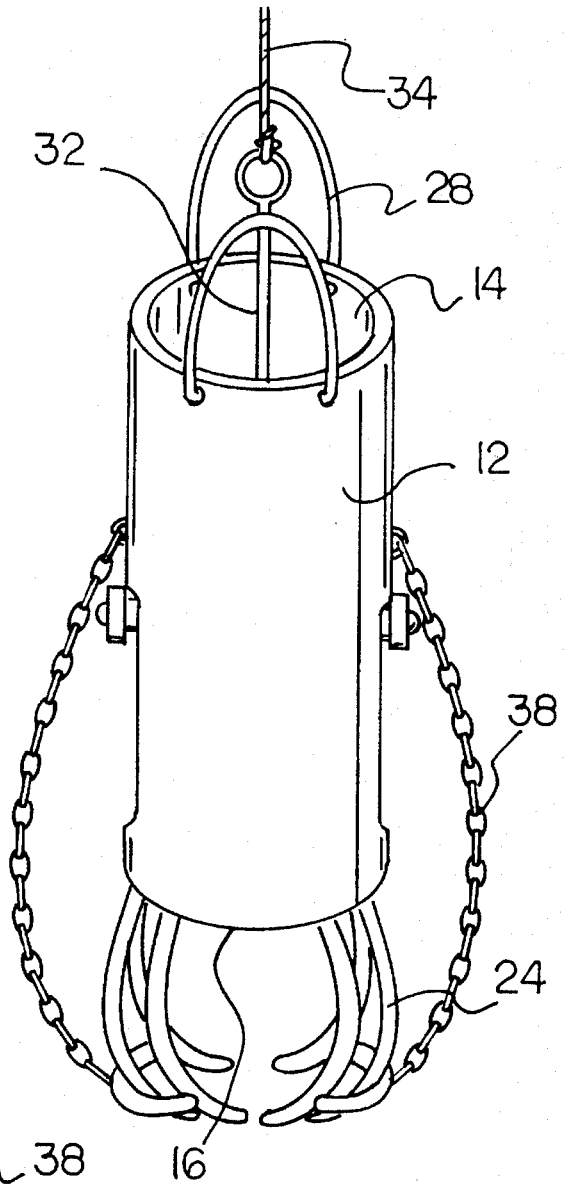
FIG. 2 is a front view of the present invention illustrating the plurality of claws in a closed configuration.

With reference now to the drawings, and in particular, to FIGS. 1–6 thereof, the preferred embodiment of the new and improved portable claw device embodying the principles and concepts of the present invention and generally designated by the reference number 10 will be described.

Specifically, it will be noted in the various Figures that the device relates to a new and improved portable claw device for engaging materials to be uplifted. In its broadest context, the device consists of a cylindrical housing, a pair of gripping claws, and a pair of lifting chains. Such components are individually configured and correlated with respect to each other so as to attain the desired objective.

The device 10 includes a cylindrical housing 12 having an open upper end 14 and an open lower end 16. The cylindrical housing 12 has a pair of diametrically opposed vertical slots 18 formed therein intermediate the upper end 14 and lower end 16 thereof. The pair of vertical slots 18 have an upper end nearly positioned at a midpoint of the cylindrical housing and a lower end positioned just above the open lower end 16. The open upper end 14 has a pair of inverted U-shaped handles 20 secured thereto. The cylindrical housing 12 has a diameter small enough to allow the device 10 to be positioned within small spaces such as manholes.

Next, the device 10 includes a pair of gripping claws 24. Each of the gripping claws 24 has a central upper end portion 26 and a plurality of arcuate lower portions 28. The plurality of arcuate lower portions 28 are held together by a lower cross bar 29. Each upper end portion 26 is coupled together by a cross bar 30. The cross bar 30 is slidably received within the pair of diametrically opposed vertical slots 18 of the cylindrical housing 12. The cross bar 30 has a vertical support bar 32 extending upwardly from a central portion thereof. The vertical support bar 32 has a lift line 34 secured to an upper end thereof. The cylindrical housing 12 is lowered within a manhole or other tight fitting area by the lift line 34. Once the housing 12 has reached an area to remove debris, the cross bar 30 lowers to the lower ends of the pair of diametrically opposed vertical slots 18 thereby allowing the plurality of arcuate lower portions 28 to expand around the debris. Once the plurality of arcuate lower portions 28 are in place around the debris, the lift line 34 is raised causing the cross bar 30 to raise thereby causing the plurality of arcuate lower portions 28 to close in around the debris allowing it to be safely lifted out of the manhole and disposed.

Lastly, the device 10 includes a pair of lifting chains 38. Each of the lifting chains 38 has a first end 40 and a second end 42. The first ends 40 are secured to the cylindrical housing 12 upwardly of the pair of diametrically opposed vertical slots 18. The second ends 42 are secured to the lower cross bar 29 of the arcuate lower portion 28 of the pair of gripping claws 24. The lifting chains 38 are used to position the pair of gripping claws 24 around the pile of debris.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A portable claw device for engaging materials to be uplifted comprising, in combination:

a cylindrical housing having an open upper end and an open lower end, the cylindrical housing having a pair of diametrically opposed vertical slots formed therein intermediate the upper end and lower end thereof, the open upper end having a pair of inverted U-shaped handles secured thereto;

a pair of gripping claws, each of the gripping claws having a central upper end portion and a plurality of arcuate lower portion, each upper end portion coupled together by a cross bar, the cross bar slidably received within the pair of diametrically opposed vertical slots of the cylindrical housing, the cross bar having a vertical support bar extending upwardly from a central portion thereof, the vertical support bar having a lift line secured to an upper end thereof;

a pair of lifting chains, each of the lifting chains having a first end and a second end, the first end secured to the cylindrical housing upwardly of the pair of diametrically opposed vertical slots, the second end secured to the arcuate lower portion of the pair of gripping claws.

2. A portable claw device comprising:

a cylindrical housing having a pair of diametrically opposed vertical slots formed therein, the cylindrical housing having a pair of inverted U-shaped handles secured to an open upper end thereof;

a pair of gripping claws coupled together by a cross bar, the cross bar slidably received within the pair of diametrically opposed vertical slots of the cylindrical housing, the cross bar having a vertical support bar extending upwardly from a central portion thereof.

3. The device as set forth in claim 2 wherein each of the pair of gripping claws having a central upper end portion and a plurality of arcuate lower portion, each upper end portion coupled together by the cross bar.

4. The device as set forth in claim 2 wherein the vertical support bar having a lift line secured to an upper end thereof.

5. The device as set forth in claim 2 and further including a pair of lifting chains, each of the lifting chains having a first end and a second end, the first end secured to the cylindrical housing upwardly of the pair of diametrically opposed vertical slots, the second end secured to the arcuate lower portion of the pair of gripping claws.

* * * * *